US005418605A

United States Patent [19]

Arahira et al.

[11] Patent Number: 5,418,605

[45] Date of Patent: May 23, 1995

[54] CHARGING DEVICE AND IMAGE FORMING APPARATUS

[75] Inventors: Fumihiro Arahira, Kanagawa; Tsuyoshi Watanabe, Ebina; Takao Honda, Yokohama; Makoto Yanagida, Kawasaki, all of Japan

[73] Assignee: Canon Kabushiki Kaisha, Tokyo, Japan

[21] Appl. No.: 155,643

[22] Filed: Nov. 22, 1993

[30] Foreign Application Priority Data

Dec. 10, 1992 [JP] Japan ..... 4-352493

[51] Int. Cl.[6] ..... G03G 15/00

[52] U.S. Cl. ..... 355/219; 361/225

[58] Field of Search ..... 355/219, 211, 212, 277, 355/273, 274, 275; 361/225

[56] References Cited

U.S. PATENT DOCUMENTS

| | | | |
|---|---|---|---|
| 4,853,737 | 8/1989 | Hartley et al. | 355/289 |
| 4,967,231 | 10/1990 | Hosoya et al. | 355/219 |
| 5,089,851 | 2/1992 | Tanaka et al. | 355/219 |
| 5,140,371 | 8/1992 | Ishihara et al. | 355/219 |
| 5,168,309 | 12/1992 | Adachi et al. | 355/219 |
| 5,187,849 | 2/1993 | Kobayashi | 355/285 X |
| 5,235,386 | 8/1993 | Yano et al. | 355/219 |

FOREIGN PATENT DOCUMENTS

| | | |
|---|---|---|
| 0087159 | 5/1986 | Japan . |
| 1-204081 | 8/1989 | Japan . |
| 0306278 | 12/1990 | Japan . |

*Primary Examiner*—Robert B. Beatty

*Attorney, Agent, or Firm*—Fitzpatrick, Cella, Harper & Scinto

[57] ABSTRACT

A charging device includes a member to be charged, and a charging member for charging the member to be charged. The charging member includes a surface layer which can contact the surface of the member to be charged. A voltage is applied between the member to be charged and the charging member. The contact angle with water $\gamma_R$ of the surface layer of the charging member is greater than the contact angle with water $\gamma_D$ of the surface of the member to be charged. An image forming apparatus includes the above-described charging device.

20 Claims, 3 Drawing Sheets

CHARGING DEVICE AND IMAGE FORMING APPARATUS

BACKGROUND OF THE INVENTION

1. Field of the Invention

This invention relates to a charging device which includes a charging member for charging a member to be charged, such as a photosensitive member or the like, and an image forming apparatus which includes the charging device.

2. Description of the Related Art

FIG. 3 a schematic diagram illustrating an electrophotographic image forming apparatus.

In this image forming apparatus, charging device 10, exposure device 11, developing device 12, transfer device 13, cleaning device 15, charge-removing device 16 and the like are disposed around photosensitive member 1, which serves as an image bearing member.

In an image forming operation, photosensitive member 1 rotates in the direction of arrow R1. After the surface of photosensitive member 1 has been uniformly charged by charging device 10, an electrostatic latent image is formed on the surface of photosensitive member 1 by exposure device 11. The electrostatic latent image is developed by providing toner from developing device 12, whereby a toner image is obtained. The toner image is transferred onto a sheet of transfer material P. Sheets of transfer material P are accommodated within sheet-feeding cassette 17. Each sheet of transfer material P is fed to photosensitive member 1 by a sheet-feeding device (not shown). The toner image on photosensitive member 1 is transferred onto the sheet of transfer material P by transfer device 13. The transferred toner image on the sheet is fixed by fixing device 19, and the sheet is then discharged outside the main body of the image forming apparatus as a final copy.

A detailed description will now be provided of the charging device 10. Charging devices are generally classified into two types, i.e., the contact-charging type and the noncontact-charging type, according to whether or not a charging member contacts a photosensitive member. In contact-charging devices, a charging member (e.g., a conductive roller) directly contacts the surface of a photosensitive member, serving as a member to be charged, and the surface of the photosensitive member is charged to a predetermined potential of a predetermined polarity by applying a voltage (e.g., a DC voltage alone, a superposed voltage of a DC voltage and an AC voltage, or the like) to the charging member. These contact-charging devices have advantages in that, for example, the value of the applied voltage can be lower than in noncontact-charging devices, in which, for example, corona charging is utilized, and that the amount of ozone generated in a charging operation can be reduced. Conventional contact-charging devices are disclosed, for example, in U.S. Pat. No. 5,188,309, and Japanese Patent Laid-open Application (Kokai) No. 1-204081 (1989).

In the above-described conventional contact-charging devices, however, since the photosensitive member directly contacts the charging member for charging it, the charging member is contaminated due to adhesion of remaining toner particles, paper power, and the like, on the photosensitive member, thereby causing insufficient charging for the photosensitive member, and further, causing an inferior image.

SUMMARY OF THE INVENTION

It is an object of the present invention to provide a charging device and an image forming apparatus in which contamination of a charging member is prevented.

It is another object of the present invention to provide a charging device and an image forming apparatus in which insufficient charging due to adhesion of foreign matter on a charging member is prevented.

It is still another object of the present invention to provide a charging device and an image forming apparatus in which stable charging characteristics can be maintained for a long period.

According to one aspect, the present invention which achieves these objectives relates to a charging device comprising a member to be charged, and a charging member for charging the member to be charged. The charging member includes a surface layer which can contact the surface of the member to be charged, and a voltage is applied between the member to be charged and the charging member. The contact angle $\gamma_R$ of the surface layer is greater than the contact angle $\gamma_D$ of the surface of the member to be charged.

According to another aspect, the present invention which achieves these objectives relates to an image forming apparatus comprising an image bearing member, and a charging member for charging the image bearing member. The charging member includes a surface later which can contact the surface of the image bearing member, and a voltage is applied to the charging member. The contact angle $\gamma_R$ of the surface layer is greater than the contact angle $\gamma_D$ of the surface of the image bearing member.

The foregoing and other objects, advantages and features of the present invention will become more apparent from the following detailed description of the preferred embodiments taken in conjuction with the accompanying drawings.

DETAILED DESCRIPTION OF THE PREFERRED EMBODIMENTS

Figure 4:
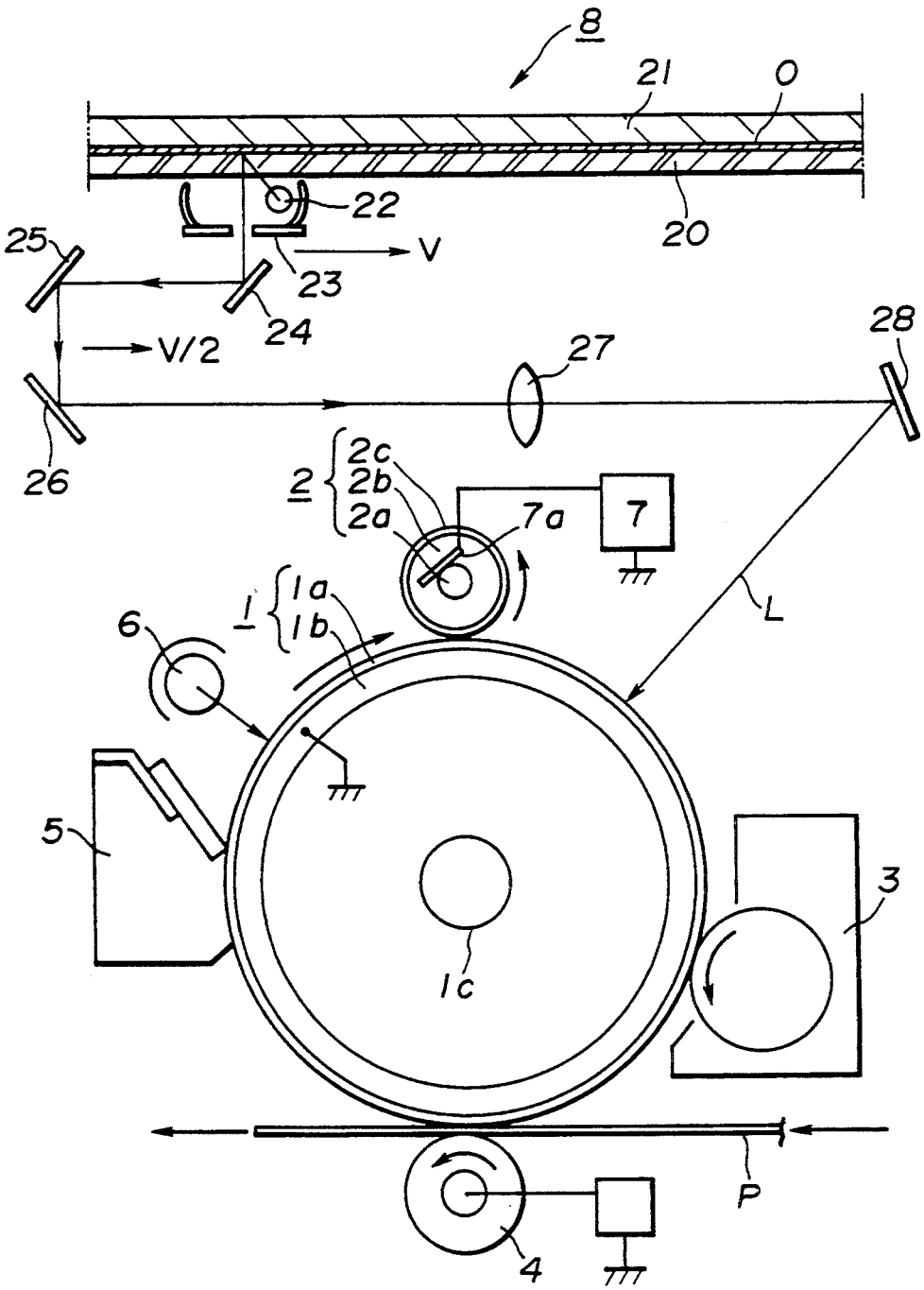
FIG. 4 a schematic diagram illustrating in cross-section an outline of an image forming apparatus according to an embodiment of the present invention.

FIG. 4 is a schematic diagram illustrating in cross-section the configuration of an image forming apparatus according to an embodiment of the present invention.

In FIG. 4, reference numeral 1 represents an image bearing member which serves as a member to be charged. In the present embodiment, image bearing member 1 is a drum-type electrophotographic photosensitive member, which is basically configured by a conductive base layer **1*b*, made of aluminum or the like, and a photoconductive layer 1*a* formed on the outer circumference thereof. In the present embodiment, photoconductive layer 1*a* is an organic photoconductive layer having a negative charging polarity. Image bearing member 1** is rotatably driven around supporting shaft 1c in a clockwise direction in FIG. 4 at a predetermined circumferential speed (process speed).

Reference numeral 2 represents a contact charging member for performing a uniform primary charging operation of the surface of photosensitive member 1, while contacting it, at a predetermined polarity and a predetermined potential. In the present embodiment, contact charging member 2 is a roller-type member (a charging roller). Charging member 2 comprises a central core bar 2a, a conductive layer 2b formed on the outer circumference thereof, and a resistive layer 2c formed on the outer circumference of conductive layer 2b. Two end portions of core bar 2a are rotatably supported by bearing members (not shown), so that charging roller 2 is disposed parallel to the drum-type photosensitive member 1, in pressure contact with the surface thereof by pressing means (not shown) with a predetermined pressing force, and is rotatably driven in accordance with the rotation of photosensitive member 1.

By applying a predetermined (negative) DC bias voltage to core bar 2a from power supply 7 via sliding contact 7a, the circumferential surface of the rotating photosensitive member 1 is subjected to contact charging (primary charging) at a predetermined polarity and a predetermined potential.

The surface of photosensitive member 1 uniformly charged to a negative potential is then subjected to an exposure L (e.g., slit exposure of a focused original image, laser-beam scanning exposure, or the like) of object-image information by exposure means 8, and an electrostatic latent image corresponding to the object-image information is formed on the circumferential surface of photosensitive member 1.

Exposure means 8 of the apparatus is slit exposure means of a focused original image type, in which an original mount is fixed and an optical system moves. Exposure means 8 includes a fixed original-mount glass 20, an original O mounted on original-mount glass 20 in a state in which the image-bearing surface is downwardly placed, an original-pressing plate 21, an original-illuminating lamp (exposure lamp) 22, a slit plate 23, a first moving mirror 24, a second moving mirror 25, a third moving mirror 26, an imaging lens 27, and a fixed mirror 28. Lamp 22, slit plate 23 and first moving mirror 24 are moved below original-mount glass 20 from one end to another end thereof at a predetermined speed V. At the same time, second moving mirror 25 and third moving mirror 26 are moved at a speed of V/2. Thus, the downwardly placed surface of original O on original-mount glass 20 is scanned from one side to another side, and the focused image of original O is subjected to slit exposure L on the surface of the rotating photosensitive member 1.

The latent image formed on the surface of photosensitive member 1 is then sequentially visualized by developing means 3 as a toner image. Toner is charged to a polarity which is opposite to that of the voltage applied to charging member 2 (i.e., positive). The toner image is then sequentially transferred by transfer means 4 onto the surface of transfer material P, which has been conveyed from sheet-feeding means (not shown) to a transfer portion between photosensitive member 1 and transfer means 4 at an appropriate timing in synchronization with the rotation of photosensitive member 1. In the present embodiment, transfer means 4 is a transfer roller. By performing a charging operation from the back of the sheet of transfer material P to a polarity which is opposite to that of the toner, the toner image on the surface of photosensitive member 1 is transferred onto the surface of transfer material P.

The sheet of transfer material P, on which the toner image has been transferred, is separated from the surface of photosensitive member 1, is conveyed to image fixing means (not shown), where the image is fixed, and is output as an image forming material. Alternatively, when an image is also to be formed on another surface of the sheet of transfer material P, transfer material P is conveyed to means for reconveying it to the transfer portion.

The surface of photosensitive member 1 is cleaned by removing contaminants, such as remaining toner particles and the like, adhering to the surface after the image transfer, by cleaning means 5, and electric charges on the surface are removed by charge-removing exposure device 6. Thus, photosensitive member 1 is repeatedly used for image formation.

Figure 1:
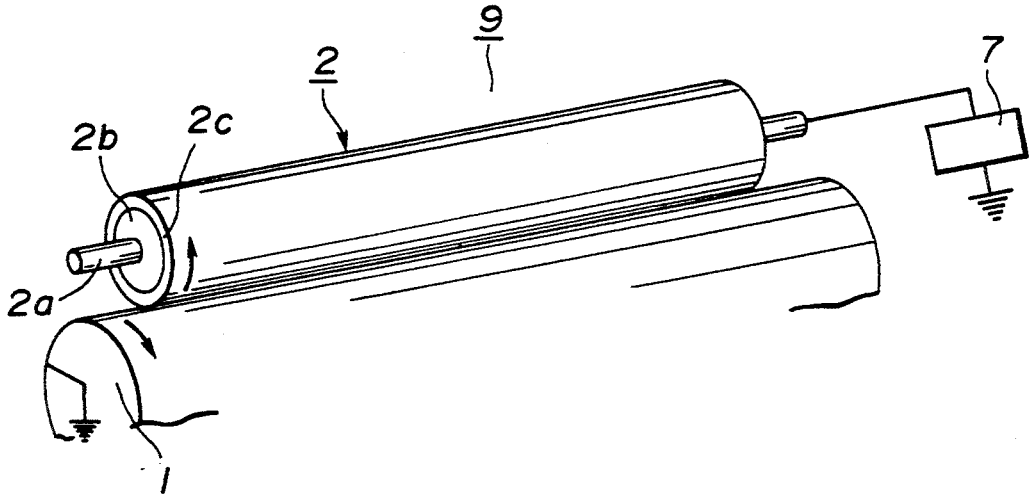
FIG. 1 is a perspective view illustrating the configuration of a conductive roller which serves as a charging member.

FIG. 1 is a perspective view of conductive roller (charging member) 2, which is an essential component of contact charging device 9 of the present embodiment. Conductive roller 2 comprises a conductive core bar 2a threaded through the center of the roller, a conductive layer 2b surrounding core bar 2a, and a surface layer 2c coated on the conductive layer 2b. Conductive roller 2 is formed in the shape of a cylinder. Power supply 7 is connected to core bar 2a. The bias voltage applied to core bar 2a from power supply 7 is applied to photosensitive member 1 via conductive layer 2b and surface layer 2c, so that the surface of photosensitive member 1 is charged.

As described above, a cylindrical photosensitive drum is used as photosensitive member 1. Core bar 2a of conductive roller 2 is disposed alone the longitudinal direction (in parallel with the axis of photosensitive drum 1) of photosensitive drum 1, and the entire conductive roller 2 is pressed against photosensitive drum 1 with a predetermined pressing force. Thus, part of the surface of photosensitive drum 1 contacts part of the surface of conductive roller 2 along the longitudinal direction of the two components, to form a contact nip having a predetermined width. Photosensitive drum 1 is rotatably driven by driving means (not shown), and conductive roller 2 is rotatably driven in accordance with the rotation of photosensitive drum 1.

Charging of photosensitive drum 1 by power supply 7 is performed via the neighborhood of the above-described contact nip. The surface of conductive roller 2 uniformly contacts the region to be charged (corresponding to the length of conductive roller 2) on the surface of photosensitive drum 1 via the contact nip, whereby the region to be charged on the surface of photosensitive drum 1 is uniformly charged. Power supply 7, supplies power to conductive layer 2b of the charging member 2 via sliding contact 7a, the sliding contact 7a being located at a side of the conductive layer 2b which is opposite the photoconductive drum 1.

In a charging operation although charging for photosensitive drum 1 is effectively performed by the above-described substantially uniform contact between the surface of photosensitive drum 1 and the surface of conductive roller 2, contaminants, such as remaining toner particles, paper powder and the like, adhering to the surface of photosensitive drum 1 may be transferred and adhere to the surface of conductive roller 2 from the surface of photosensitive drum 1 via the contact nip, thereby contaminating the surface of conductive roller 2. Such contamination is slight for a short time period.

However, if charging device 9 is used for a long time period without removing the above-described contaminants, then the contaminants will accumulate on the surface of conductive roller 2, thereby causing insufficient charging of photosensitive drum 1, and further causing an inferior image.

Figure 2:
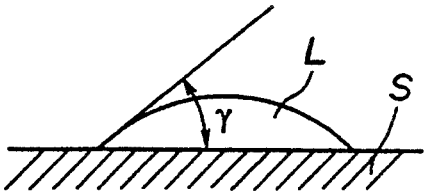
FIG. 2 is a diagram illustrating the contact angle between a solid and a liquid.
Figure 3:
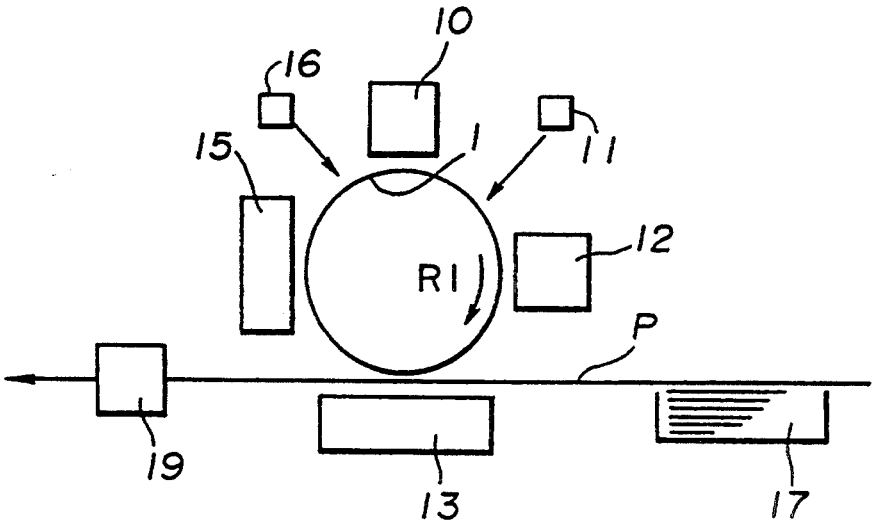
FIG.3 PRIOR ART
FIG. 3 is a schematic diagram illustrating the configuration of a conventional image forming apparatus.

Accordingly, in the present embodiment, in order to prevent contamination of the surface of conductive roller 2, surface layer 2c on the uppermost surface of conductive roller 2 is made of a material to which contaminants are less apt to adhere. Contaminants adhering to the surface of photosensitive drum 1 pass through the contact nip in accordance with the rotation of photosensitive drum 1. When the contaminants are pressed at the contact nip at that time, the contaminants will either remain on the surface of photosensitive drum 1, or move from photosensitive drum 1 to surface layer 2c of conductive roller 2. Accordingly, if it is arranged so that the contaminants are less apt to adhere to surface layer 2c than to the surface of photosensitive drum 1, then transfer of the contaminants to surface layer 2c can be prevented. More specifically, the material of surface layer 2c is selected so that the contact angle of surface layer 2c of conductive roller 2 is greater than the contact angle of the surface of photosensitive drum 1. As shown in FIG. 2, the contact angle is an angle ($\gamma$) made by the surface of solid S and the liquid surface when liquid L, such as water or the like, contacts the surface of solid S whose contact angle must be measured. When the contact angle $\gamma$ has a large value, it indicates that the solid is less apt to get wet with the liquid, or, in other words, the solid is nonsticky. Similarly, in the case of contaminants, such as toner particles or the like, when the contact angle $\gamma$ has a large value, it indicates that contaminants are less apt to adhere.

Adhesion of contaminants to surface layer 2c is more apt to occur when the polarity of the bias voltage applied to conductive roller 2 is opposite the polarity of electric charges of toner. That is, toner particles are more apt to adhere to the charging member in the case of normal development than in the case of reversal development. Accordingly, the necessity to satisfy the above-described condition for the contact angle $\gamma$ is greater in normal development.

When a material which satisfies the above-described condition for the contact angle is used for surface layer 2c of conductive roller 2, transfer of contaminants, which are present in the contact nip between photosensitive drum 1 and conductive roller 2, to surface layer 2c can be prevented, since they remain on the surface of photosensitive drum 1 which is more sticky than surface layer 2c. The contaminants remaining on the surface of photosensitive drum 1 are efficiently removed by cleaning device 5 shown in FIG. 4.

The contact angle $\gamma$ can be measured by an angle-measuring device, such as a goniometer or the like. If it is arranged so that the relationship $\gamma_D<\gamma_R$ holds between the contact angle $\gamma_D$ of the surface of photosensitive drum 1 and the contact angle $\gamma_R$ of surface layer 2c of conductive roller 2 based on the result of measurement of the contact angles, then adhesion of contaminants to surface layer 2c of conductive roller 2 can be prevented. In order to securely prevent contamination of conductive roller 2, it is preferable to satisfy the following relationship:

$$\gamma_D<\gamma_R-5 \text{ (in units of a degree).}$$

The contact angle which can maintain sufficient surface releasability for the photosensitive drum equals preferably at least 70°, and the contact angle of the charging member equals preferably at least 75°.

If the contact angle $\gamma_R$ of surface layer 2c is smaller than the contact angle $\gamma_D$ of the surface of photosensitive drum 1, then contaminants on photosensitive drum 1 are apt to adhere to surface layer 2c. Hence, contamination of the surface of conductive roller 2 cannot be prevented, and an inferior image is apt to be produced.

Conductive layer 2b is made of a nonmetallic material. It is preferable to use a material having low hardness for conductive layer 2b in order to stabilize the contact state between it and photosensitive drum 1. For example, a resin, such as polyurethane, polyester, polyvinyl alcohol or the like, or a rubber, such as a ternary copolymer of EPDM (ethylene propylene dien monomer), NBR (nitrile-butadiene rubber) or the like, is used. Carbon black, carbon graphite, titanium oxide, zinc oxide or the like is used as a conductive pigment.

In the present embodiment, a material which provides a medium resistance value ($10^6$–$10^{10}\Omega$) is used for surface layer 2c in the image region in the axial direction of photosensitive drum 1. For example, polyamide, polyimide, polyurethane, polyester, silicone, Teflon or the like is used as a resin. In order to adjust the resistance to a medium resistance value, a conductive pigment, such as carbon black, carbon graphite, titanium oxide, zinc oxide or the like, may be appropriately added. A material which provides a resistance value equal to or less than $1\times10^6\Omega$ is not preferable, since the breakdown voltage of the layer is insufficient when damage or the like is produced in photosensitive drum 1. A material which provides a resistance value of at least here $1\times10^{10}\Omega$ is not preferable, since current does not flow and insufficient charging will occur. Accordingly, the resistance of surface layer 2c in the direction of the radius of conductive roller 2 is preferably greater than $1\times10^6\Omega$, and smaller than $1\times10^{10}\Omega$.

Examples of the present invention will be hereinafter described. However, the present invention is not limited to these examples.

EXAMPLE 1

A ternary copolymer of EPDM in which carbon black is dispersed was used for conductive layer 2b of conductive roller 2. Tin oxide was dispersed in Toresin (EF-30T, made by Teikoku Kagaku Kabushiki Kaisha), a polyimide resin, so that the resistance of surface layer 2c becomes $10^9\Omega$. Surface layer 2c was formed by a dipping method, and was dried by heated at 150° C. for 30 minutes. Thus, conductive roller 2 was provided.

A butylene acrylic resin was used for the surface layer of photosensitive drum 1. The value of the contact angle of the surface for water measured by a goniometer was 72°.

The above-described conductive roller 2 was installed and adjusted at a predetermined position as the primary charger of the image forming apparatus shown in FIG. 4. The following items were evaluated using this conductive roller 2. The results are shown in Table 1.

(1) The contact angle of surface layer 2c of conductive roller 2 for water was measured by a goniometer.

(2) A durability test for forty thousand sheets was performed using the image forming apparatus in the environment of a temperature of 25.5° C. and a relative humidity of 5%. Obtained images were visually evaluated according to the following evaluation criteria:

⊙: No problem with an excellent image

○: Generation of an image having slightly insufficient charging (practically usable)

Δ: Generation of an image having partially insufficient charging (lower limit of practical use)

X: Generation of an image having insufficient charging (not practically usable)

EXAMPLE 2

The same configuration as in Example 1 was adopted, except that a polyurethane resin (MW002, made by Sanyo Kasei Kabushiki Kaisha), in which tin oxide is dispersed in order to adjust the resistance and a fluororesin (tetrafluoroethylene resin) is dispersed in order to improve the releasability of the surface, was used for surface layer 2c of conductive roller 2. The same evaluation as in Example 1 was performed.

EXAMPLE 3

The same configuration as in Example 2 was adopted, except that a polycarbonate resin having a contact angle of 89° was used for the surface layer of photosensitive drum 1. The same evaluation as in Example 2 was performed.

EXAMPLE 4

The same configuration as in Example 1 was adopted, except that only titanium oxide was used as the conductive pigment for surface layer 2c of conductive roller 2. The same evaluation as in Example 1 was performed.

EXAMPLE 5

The same configuration as in Example 1 was adopted, except that only Toresin, a polyamide resin, was used for surface layer 2c of conductive roller 2. The same evaluation as in Example 1 was performed.

COMPARATIVE EXAMPLE 1

The same configuration as in Example 1 was adopted, except that a polycarbonate resin having a contact angle of 89° was used for the surface layer of photosensitive drum 1. The same evaluation as in Example 1 was performed.

COMPARATIVE EXAMPLE 2

The same configuration as in Example 4 was adopted, except that a polycarbonate resin having a contact angle of 89° was used for the surface layer of photosensitive drum 1. The same evaluation as in Example 4 was performed.

COMPARATIVE EXAMPLE 3

The same configuration as in Example 1 was adopted, except that a styrene-acrylic resin, in which tin oxide is dispersed, was used for surface layer 2c of conductive roller 2 by coating the resin by a dipping method, and drying the coated resin by heating it at 100° C. for 30 minutes. The same evaluation as in Example 1 was performed.

Table 1 illustrates the results of evaluation of the above-described Examples 1–5 and Comparative Examples 1–3.

TABLE 1

| No. | Contact angle (°) Conductive roller | Contact angle (°) Photosensitive drum | Evaluation of image |
|---|---|---|---|
| Example 1 | 80 | 72 | ○ |
| Example 2 | 95 | 72 | ⊙ |
| Example 3 | 95 | 89 | ○ |
| Example 4 | 75 | 72 | Δ |
| Example 5 | 78 | 72 | ○ |
| Comparative Example 1 | 80 | 89 | X |
| Comparative Example 2 | 75 | 89 | X |
| Comparative Example 3 | 69 | 72 | X |

As described above, according to the present invention, by using a material, whose contact angle is greater than the contact angle of the surface of a member to be charmed, for a surface layer of a charging member, it is possible to prevent the transfer and adhesion of contaminants on the member to be charmed to the surface layer of the charging member via a contact nip between the member to be charged and the surface layer of the charging member. Hence, it is possible to prevent insufficient charging due to contamination of the charging member by contaminants accumulated for a long period, to perform stable charging for a lone period, and to provide an excellent image.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A charging device for charging a member to be charged, the member to be charged having a surface with a contact angle with water $\gamma_D$, said charging device comprising:

a charging member for charging the member to be charged, said charging member including a surface layer contactable with the surface of the member to be charged and having a contact angle with water $\gamma_R$, with a voltage applied between the member to be charged and said charging member, wherein the contact angle $\gamma_R$ of said surface layer is greater than the contact angle $\gamma_D$ of the surface of the member to be charged.

2. A charging device according to claim 1, wherein said charging member further comprises a rotating member.

3. A charging device according to claim 1, wherein the contact angle $\gamma_R$ of said surface layer of said charging member and the contact angle $\gamma_D$ of the surface of the member to be charged satisfy the following relationship:

$$\gamma D<(\gamma_R-5)^\circ.$$

4. A charging device according to claim 1 or 3, wherein the contact angle $\gamma_R$ of said surface layer of said charging member equals at least 75°.

5. A charging device according to claim 1 or 3, wherein the contact angle $\gamma_D$ of the surface of the member to be charged equals at least 70°.

6. A charging device according to claim 1, wherein said charging member further comprises a conductive layer at a side of said surface layer of said charging member which is opposite the side of said surface layer facing the member to be charged in a charging region between the charging member and the member to be charged.

7. A charging device according to claim 6, wherein said charging member further comprises an electrode member at a side of said conductive layer which is opposite the side of said conductive layer facing the member to be charged in a charging region.

8. A charging device according to any one of claims 1, 6 and 7, wherein the resistance of said surface layer of said charging member is greater than $1\times10^6\Omega$ and smaller than $1\times10^{10}\Omega$.

9. A charging device according to claim 1, wherein the member to be charged comprises a photosensitive member.

10. An image forming apparatus, comprising:

an image bearing member having a surface with a contact angle with water $\gamma_D$; and a charging member for charging said image bearing member, said charging member including a surface layer contactable with the surface of said image bearing member and having a contact angle with water $\gamma_R$, with a voltage applied to said charging member, wherein the contact angle $\gamma_R$ of said surface layer is greater than the contact angle $\gamma_D$ of the surface of said image bearing member.

11. An image forming apparatus according to claim 10, wherein said charging member comprises a rotating member.

12. An image forming apparatus according to claim 11, wherein said charging member is a roller.

13. An image forming apparatus according to claim 10, wherein the contact angle $\gamma_R$ of said surface layer and the contact angle $\gamma_D$ of the surface of said image bearing member satisfy the following relationship:

$$\gamma_D<(\gamma_R-5)^\circ.$$

14. An image forming apparatus according to claim 10 or 13, wherein the contact angle $\gamma_R$ of said surface layer equals at least 75°.

15. An image forming apparatus according to claim 10 or 13, wherein the contact angle $\gamma_D$ of the surface of said image bearing member equals at least 70°.

16. An image forming apparatus according to claim 10, wherein said charging member includes a conductive layer at a side of said surface layer which is opposite said image bearing member in a charging region between the charging member and the image bearing member.

17. An image forming apparatus according to claim 16, wherein said charging member includes an electrode member at a side of said conductive layer which is opposite said image bearing member in a charging region.

18. An image forming apparatus according to any one of claims 10, 16 and 17, wherein the resistance of said surface layer is greater than $1\times10^6\Omega$ and smaller than $1\times10^{10}\Omega$.

19. An image forming apparatus according to claim 10, wherein said image bearing member comprises a photosensitive member.

20. An image forming apparatus according to claim 10, further comprising toner-image forming means including toner for forming a toner image on said image bearing member, wherein a charging polarity of the toner is opposite a charging polarity of the voltage.

* * * * *

UNITED STATES PATENT AND TRADEMARK OFFICE

CERTIFICATE OF CORRECTION

PATENT NO. : 5,418,605 Page 1 of 2

DATED : May 23, 1995

INVENTOR(S) : FUMIHIRO ARAHIRA, ET AL.

It is certified that error appears in the above-indentified patent and that said Letters Patent is hereby corrected as shown below:

On the title page:

At [56] FOREIGN PATENT DOCUMENTS

"0306278 12/1990 Japan" should read --2-306278 12/1990 Japan--; and

"0087159 5/1986 Japan" should read --61-87159 5/1986 Japan--.

Column 1

Line 65, "power," should read --powder,--.

Column 4

Line 58, "operation" should read --operation,--.

Column 6

Line 35, "here" should be deleted.

UNITED STATES PATENT AND TRADEMARK OFFICE

CERTIFICATE OF CORRECTION

PATENT NO. : 5,418,605 Page 2 of 2

DATED : May 23, 1995

INVENTOR(S) : FUMIHIRO ARAHIRA, ET AL.

It is certified that error appears in the above-indentified patent and that said Letters Patent is hereby corrected as shown below:

Column 8

Line 19, "charmed," should read --charged,--;
Line 21, "charmed" should read --charged--; and
Line 28, "lone" should read --long--.

Signed and Sealed this

Thirty-first Day of October 1995

Bruce Lehman

BRUCE LEHMAN

*Commissioner of Patents and Trademarks*

*Attest:*

*Attesting Officer*